US008876371B2

(12) United States Patent
Behrend et al.

(10) Patent No.: US 8,876,371 B2
(45) Date of Patent: Nov. 4, 2014

(54) WATCH CASE

(75) Inventors: Raoul Behrend, Preverenges (CH); Julien Cattaneo, Esery (FR); Olivier Kuffer, Le Grand-Saconnex (CH); Antonio Meleddu, Lausanne (CH)

(73) Assignee: Rolex S.A., Geneva (CH)

( * ) Notice: Subject to any disclaimer, the term of this patent is extended or adjusted under 35 U.S.C. 154(b) by 475 days.

(21) Appl. No.: 13/257,041

(22) PCT Filed: Mar. 8, 2010

(86) PCT No.: PCT/CH2010/000061

§ 371 (c)(1),
(2), (4) Date: Sep. 16, 2011

(87) PCT Pub. No.: WO2010/105377

PCT Pub. Date: Sep. 23, 2010

(65) Prior Publication Data

US 2012/0002513 A1 Jan. 5, 2012

(30) Foreign Application Priority Data

Mar. 19, 2009 (EP) ..... 09405052
Nov. 25, 2009 (EP) ..... 09405202

(51) Int. Cl.

| | |
|---|---|
| ***G04B 37/00*** | (2006.01) |
| ***G04G 17/08*** | (2006.01) |
| ***G04B 43/00*** | (2006.01) |
| ***G04B 37/11*** | (2006.01) |
| ***G04B 37/05*** | (2006.01) |
| ***G04B 39/02*** | (2006.01) |

(52) U.S. Cl.

CPC ..... *G04B 37/052* (2013.01); *G04G 17/08* (2013.01); *G04B 43/002* (2013.01); *G04B 37/11* (2013.01); *G04B 39/02* (2013.01)

USPC ..... 368/286; 368/281

(58) Field of Classification Search

USPC ..... 368/286, 294, 281, 287, 291, 292, 295

See application file for complete search history.

(56) References Cited

U.S. PATENT DOCUMENTS 2,237,860 A * 4/1941 Bolle ..... 368/289
3,187,639 A * 6/1965 Kelly et al. ..... 92/47

(Continued)

FOREIGN PATENT DOCUMENTS

CH 259168 A 1/1949
CH 259169 A 1/1949

(Continued)

OTHER PUBLICATIONS

International Search Report of PCT/CH2010/000061, mailing date May 25, 2010.

*Primary Examiner* — Amy Cohen Johnson
*Assistant Examiner* — Jason Collins
(74) *Attorney, Agent, or Firm* — Westerman, Hattori, Daniels & Adrian, LLP

(57) ABSTRACT

A watch case includes a middle (2, 24, 34), one opening of which is closed by a bezel (8, 18, 28) and/or a crystal (1, 11, 21), or by a back (40). An element for closing the opening is connected to the middle by a resilient metal member (3, 23, 33) having a recessed cross-section defined by the profile of a non-rectilinear wall having a constant thickness, whose ends (3*a*, 3*b*) are connected to the periphery of the closing element (1, 11, 21, 18), respectively. The profile of the non-rectilinear wall defines at least one annular fold having an orientation parallel to the plane of the opening, the fold being formed by a curvature whose arc defines an angle of between >90° and 180°, so as to impart to the closing member (1, 11, 21, 18) a freedom of movement relative to the plane of the opening.

20 Claims, 5 Drawing Sheets

(56) References Cited

U.S. PATENT DOCUMENTS

| | | | | | |
|---|---|---|---|---|---|
| 3,855,786 | A | * | 12/1974 | Yamamoto | 368/287 |
| 4,199,931 | A | * | 4/1980 | Yokoyama | 368/318 |
| 4,258,432 | A | * | 3/1981 | Zafferri et al. | 368/250 |
| 4,668,101 | A | * | 5/1987 | Wuthrich | 368/296 |
| 5,932,360 | A | * | 8/1999 | Hazlitt et al. | 428/621 |
| 7,242,641 | B2 | * | 7/2007 | Sato et al. | 368/205 |
| 7,619,948 | B2 | * | 11/2009 | Takasawa | 368/232 |
| 8,411,533 | B2 | * | 4/2013 | Mieville et al. | 368/244 |

FOREIGN PATENT DOCUMENTS

| | | | |
|---|---|---|---|
| CH | 630220 | A3 | 6/1982 |
| CH | 632387 | A3 | 10/1982 |
| CH | 686600 | A3 | 5/1996 |
| CH | 698742 | B1 | 10/2009 |
| EP | 0028429 | A1 | 5/1981 |
| WO | 20081/027140 | A2 | 3/2008 |

* cited by examiner

WATCH CASE

BACKGROUND ART

The present invention relates to a watch case comprising a middle at least one opening of which is closed by a bezel and/or a crystal, or by a back, and in which at least one of the elements for closing the opening is linked to the middle by a resilient metal member in the form of a ring or an endless frame and having a recessed cross section defined by the contour of a non-rectilinear wall of controlled thickness whose ends are attached to the periphery of said closing element, respectively of the middle.

It may be advantageous to make the crystal or the back of a watch mobile relative to the middle, and do so without compromising the seal-tightness of the case, for example to improve the impact resistance, or to provide new functions. The solutions proposed in the state of the art are not satisfactory in this respect.

The documents CH630220 and CH686600 describe means for making a crystal move at variable frequencies by means of an electromagnet or a piezoresistive element. Mention is made of a thin annular ring which provides elastic suspension for the crystal. The mobility of the crystal relative to the middle is very limited both in the plane of the crystal and in the plane perpendicular to the crystal, and the seal-tightness is not guaranteed by construction.

CH 632387 and CH 698742 propose forming a resilient link piece between a sound generator and a watch crystal. This link piece is formed by a number of annular segments each having, seen in cross section, a rectilinear form, which has the effect of limiting the amplitude of the mobile piece associated with this link piece.

The document WO 2008027140 describes a mobile (tilting) bezel for activating different functions. The mobility of this bezel is due to a piece made of rubber or of polyurethane, which does not, however, ensure the seal-tightness and whose reliability can be doubted in the long term.

SUMMARY OF THE INVENTION

The aim of the present invention is to give a freedom of movement that is controlled in direction and in amplitude to the closing element fitted on the middle, bezel and/or crystal or even back, according to the role that is to be conferred on this closing element.

To this end, the subject of the present invention is a watch case as claimed in claim 1.

Advantageously, the profile of said wall includes a plurality of alternate annular folds, the number of which is between 1 and 10.

Preferably, the thickness e of said wall is constant and between 10 μm and 200 μm, the width a of the annular fold is between 0.2 mm and 4 mm, the pitch p of the annular fold being between >40 μm and 2.5 mm, to give said closing element a freedom of movement, with controlled stiffness and orientation relative to the plane of the opening.

Even more advantageously, the ends of the profile of said wall are linked in a seal-tight manner to the periphery of said closing element, respectively of the middle.

According to a preferred embodiment of the invention, seals are fitted between the respective cylindrical ends of said wall adjacent to cylindrical seats of said closing element, respectively of said middle and compression rings or frames in order to ensure the seal-tightness of said case.

BRIEF DESCRIPTION OF THE DRAWINGS

Other particular features and characteristics of the present invention will become apparent from the following description and the appended drawings which illustrate, schematically and by way of examples, different embodiments and variants of the present invention.

DETAILED DESCRIPTION OF PARTICULAR EMBODIMENTS

Figure 1:
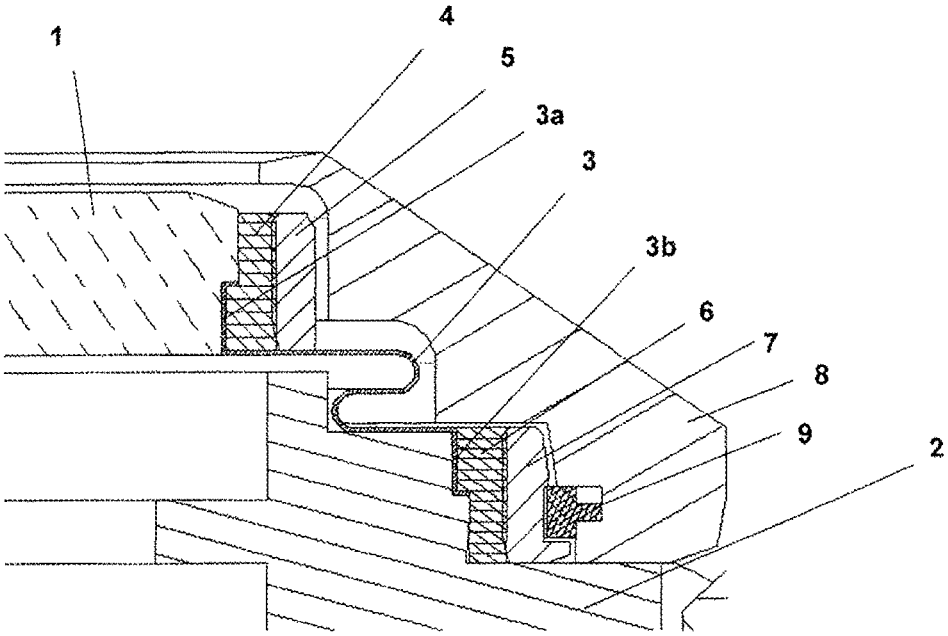
FIG. 1 is a partial cross-sectional view of a first embodiment.

The resilient metal member, in the form of a ring or endless frame and having a recessed cross section defined by the profile of a non-rectilinear wall, advantageously with a substantially constant thickness, whose ends are respectively attached to the periphery of a closing element and an opening of the middle of a watch case according to the present invention, forms a bellows comprising at least one annular fold formed by a curvature, the arc of which describes an angle of between >90° and 180°, to give said closing element a freedom of movement relative to the plane of the opening of the middle.

The metal bellows are elements formed from a thin metal wall, with a profile that is carefully chosen to confer a given flexibility, stiffness and resistance to the whole. There are several types of metal bellows: rolled, hydro-formed, chemically deposited, electroformed, this list being non-exhaustive.

The electro-formed bellows are of particular interest. Their manufacturing technique is more than 150 years old, but it is only over recent years that components with complex geometries and small (of the order of ten or so microns) and well controlled thicknesses have been able to be obtained. The challenge in controlling the thickness consists in acting on the deposition parameters (for example, distances between electrodes, nature of the electrodes, stirring and chemical composition of the bath, etc.) so as to minimize the thickness variations associated with the current density variations along a geometry with strong changes of curvature. Precise control of the geometry and of the thickness makes it possible to develop bellows with a suitable stiffness and that are capable of giving the element for closing the opening of the middle a freedom of movement relative to the plane of this opening. The companies Servometer and Nicoform are examples of miniature electro-formed bellows suppliers. These bellows are described, for example, in U.S. Pat. No. 3,187,639 and U.S. Pat. No. 5,932,360. The websites www.servometer.com and www.nicoform.com also give a lot of information on the technique and the materials used.

Such bellows can be joined to other rigid pieces to facilitate their integration. Care must be taken to ensure that the chosen assembly methods and the materials used are suited to the stresses that the assembly will undergo without the associated function being compromised.

The assemblies can be produced by gluing, by brazing or by welding by an electronic bombardment or by laser, or by a combination of at least two of these methods. If, for example, seal-tightness is to be guaranteed, gluing or tinning may prove insufficient. Furthermore, depending on the materials used, an excessively high temperature in the process may degrade their properties. If the constraints demand a good corrosion resistance, care must also be taken to use suitable materials or material pairings.

The substance used for the bellows is typically nickel or different nickel-based alloys with specific properties. Other materials such as gold, bronze, silver, titanium, tin, zinc or copper are possible alternatives, in solid form or as nickel-plating finishing coat. Furthermore, there are other polymer-based finishing coats. Given the above comments, it is possible to devise different variants of assembly and association of materials for specific applications. In each case, account must be taken of the materials involved when geometrically dimensioning the system to obtain a suitable stiffness. A few known examples are:

- Ordinary nickel (Ni+cobalt: 99.8%) with 0.04% sulfur (bright appearance), and 0.05% impurities (oxygen and carbon) becomes brittle toward 177° C., so this alloy cannot be welded. A nickel with a lower sulfur content (no more than 0.02%, satinized appearance) is more resistant than the previous one and can be welded. Furthermore, the latter offers the advantage of better corrosion resistance than ordinary nickel. The same applies for a nickel with a higher cobalt content (3-10%) which has a greater hardness.
- A thin layer of copper, around 3 microns, deposited between two equal thicknesses of nickel ensures seal-tightness of the bellows in an ultra-high vacuum.
- Gold-plating the nickel, just like the production of the bellows using solid gold, allow for flux-free welding at higher temperature. Such a system is particularly advantageous when assembling a bellows with a rigid part made of titanium. The surfaces are corrosion resistant, and confer a good electrical conductivity and are useful in microwave connection applications.
- Zinc plating is an interesting alternative to gold for corrosion protection applications (lost anode protection).
- Silver plating is useful in microwave connection applications.
- A coating with a film of poly-p-xylylene polymer, commonly called parylene, with low dielectric permittivity, exhibits excellent stability (resistance to solvents and thermal endurance). It is also biocompatible and biostable. These properties make it particularly advantageous as a barrier to the environment (corrosion) and an insulating layer.
- The use of solid copper or a nickel-phosphorus alloy may prove advantageous for their paramagnetic properties (nickel is ferromagnetic).

The embodiment illustrated by FIG. 1 relates to the fixing of a watch crystal 1 to close the top opening of a middle 2 of a watch case.

The watch crystal 1 is linked to the middle 2 by a resilient metal member 3 in the form of a ring with a recessed cross section defined by the profile of a non-rectilinear wall of constant thickness, forming a metal bellows, the ends 3*a*, 3*b* of which are attached to the periphery of the crystal 1, respectively of the middle 2. An annular seal 4 surrounds the periphery of the crystal and the end 3*a* of the metal bellows 3. A compression ring 5, made for example of titanium, compresses the annular seal against the periphery of the crystal 1. The end 3*a* of the bellows is thus captive between the annular seal 4 and the crystal 1.

The other end 3*b* of the bellows 3 is fixed in the same way against a cylindrical portion of the middle 2 by an annular seal 6 compressed by a titanium ring 7. A bezel 8 is fixed to the middle by a ring 9 fixed against a seat formed on the outer lateral face of the titanium ring 7.

As can be appreciated, the crystal 1 is held only by an end of the bellows 3, such that it is suspended elastically over the middle 2. This assembly can then serve as an impact damper; it may be capable of tilting to activate functions; or else serve as a loudspeaker, a pressure-sensitive system (balance, barometer, etc.), without this list being limiting.

Figure 2:
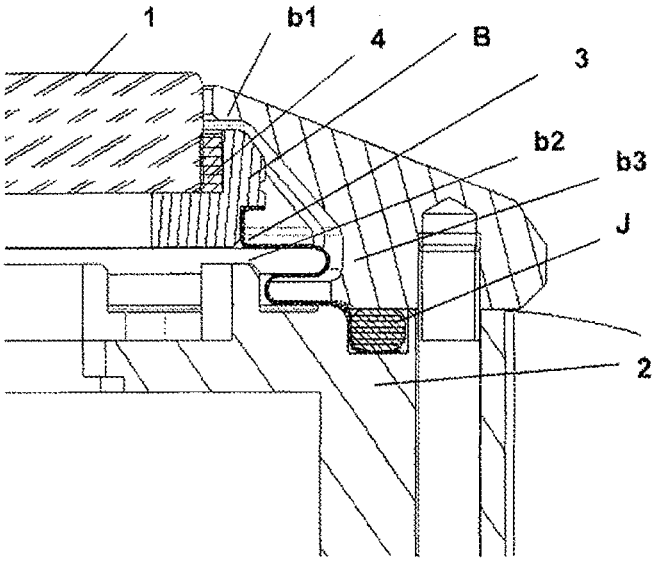
FIG. 2 is a cross-sectional view of a variant of FIG. 1.

Other variants of the assembly method described in FIG. 1 can be imagined:

- One or both ends of the bellows 3 are joined by gluing, welding or brazing to a rigid ring, or even directly to the middle, to facilitate the integration of the system in the case. In the diagram of FIG. 2, a ring B, for example made of titanium, which holds the crystal 1 and its seal 4, is welded to the bellows, for example made of solid gold. The other end on the middle 2 side is clamped with a compression seal J against the bezel and the middle 2. This assembly is perfectly seal-tight and withstands the stresses of the external environment.
- It is also possible to produce an assembly in which the crystal 11 and the bezel 18 are attached as diagrammatically represented in FIG. 3. The bezel-crystal assembly suspended from the middle by the bellows 23 can be used to actuate one or more thrusters P, in order to control the functions of a stopwatch, to make a rapid change of date or time zone, or to control any other function. In the same figure, a bellows S is also, schematically represented for linking in a seal-tight manner the winding and/or time-setting button C to the case B.

Figure 4:
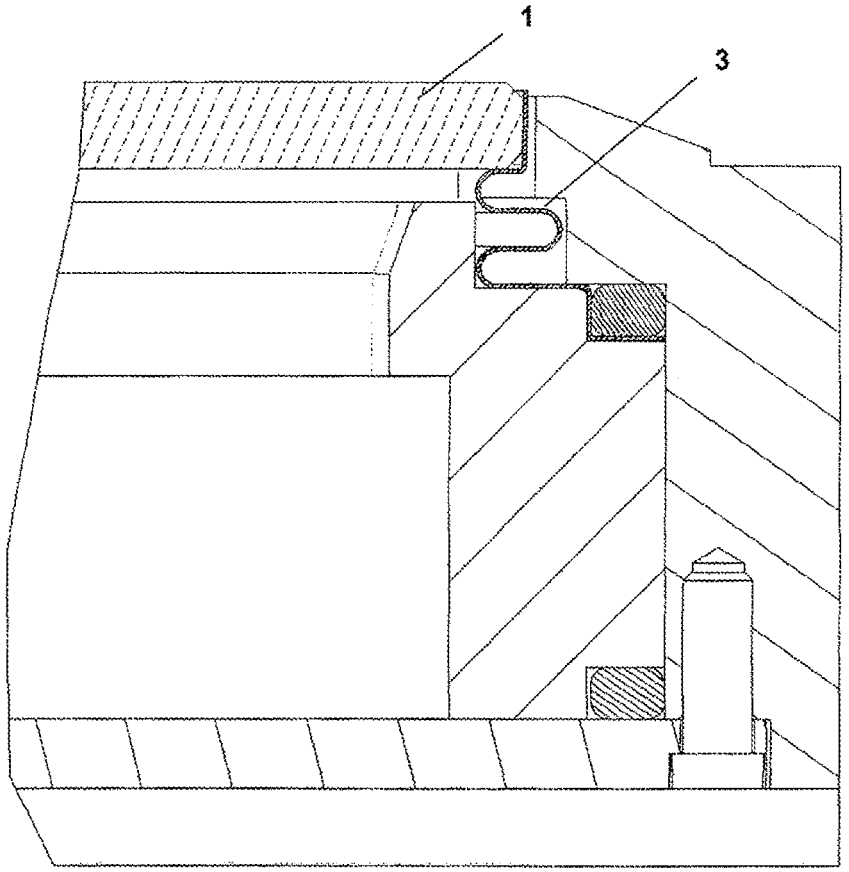
FIG. 4 is a cross-sectional view of an embodiment relating to a square or rectangular watch case.
Figure 4A:
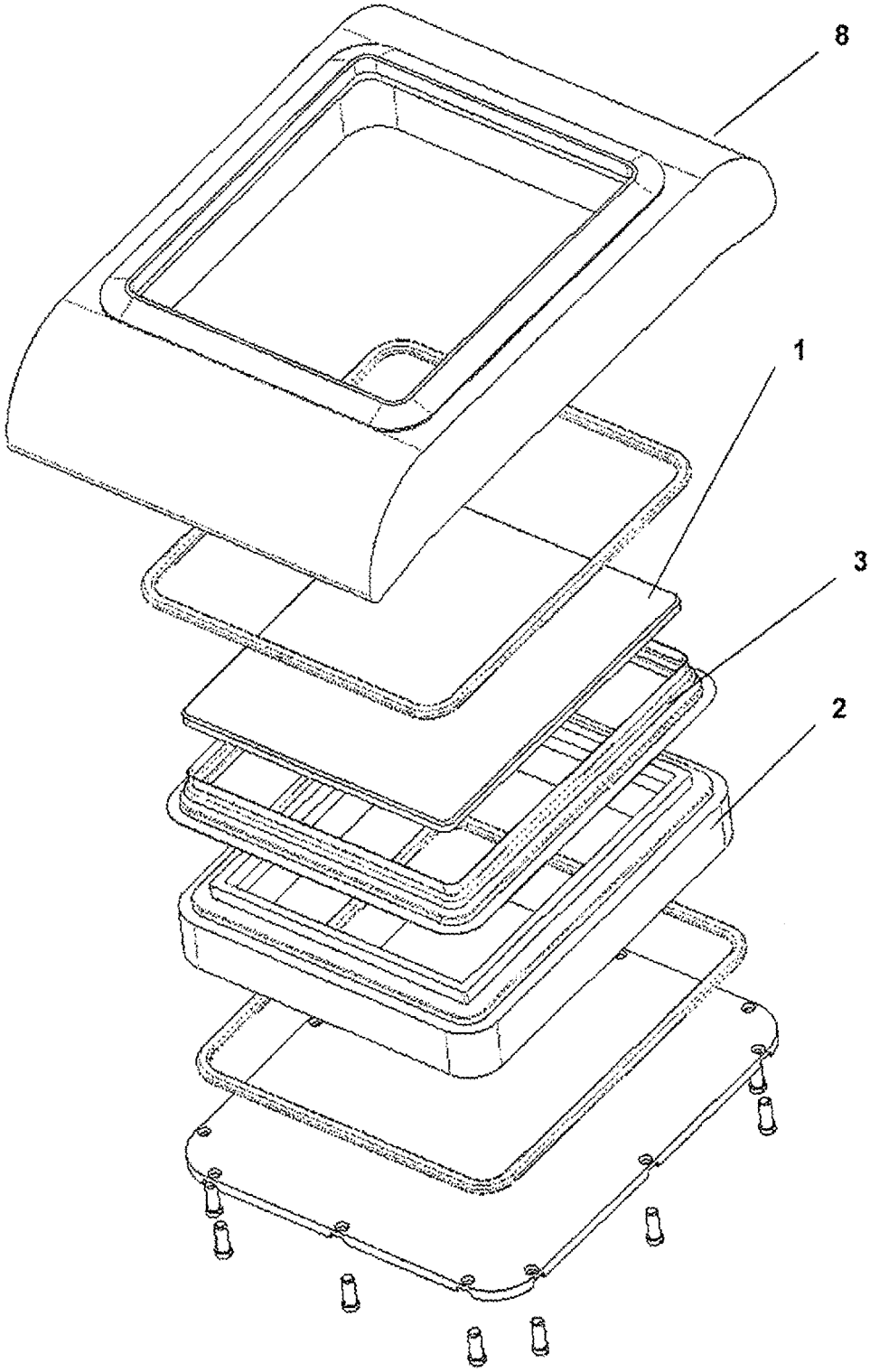
FIG. 4*a* is an exploded perspective view of FIG. 4.

It should be noted that the assembly methods described hereinabove are not limited by their method of manufacture to cylindrical geometries. It is possible to produce complex geometries combining curves and straight lines with a high degree of freedom, as in the embodiment illustrated by FIGS. 4 and 4*a*.

Figure 5:
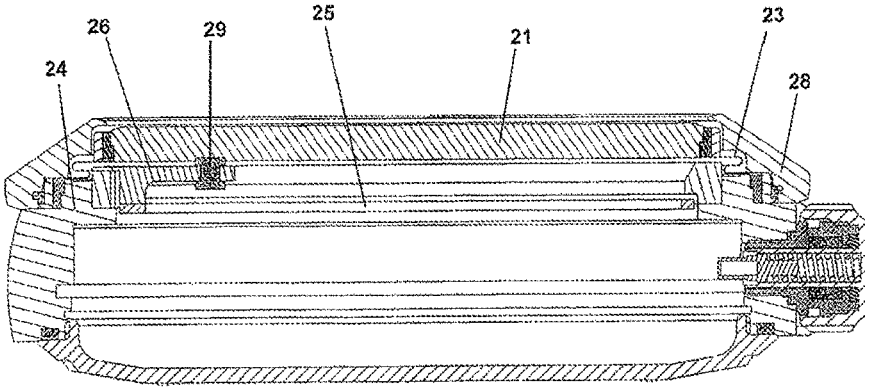
FIG. 5 is a cross-sectional view of a particular use of the watch case according to the invention.

FIG. 5 illustrates a bellows 23 incorporated between the middle 24 and the crystal 21, under the bezel 28, with a gong 25 and a return element 26 for returning the gong toward the crystal 21 and a bearing element 29 bearing against the crystal 21. In this assembly, the fixing of the crystal with a flexible bellows makes it possible to transmit toward the outside vibrations generated inside the case (or vice versa), while preserving the seal-tightness of the case. The crystal-bellows assembly can advantageously be dimensioned so that its natural frequency is situated at values higher than the frequency band of the transmitted signal (from 100 to 4000 Hz for example); the transmitted signal is therefore neither degraded nor modified (distortion). The geometry of the bellows in no way detracts from the esthetics of the piece and can easily be incorporated. The thickness of the wall of the bellows is of the order of 50 microns, which guarantees a sufficient lateral robustness. As illustrated in FIG. 2, protections are nevertheless provided by the presence of vertical b1 and b2 or lateral b3 abutments to avoid damage to the system from very strong external stresses.

Figure 6:
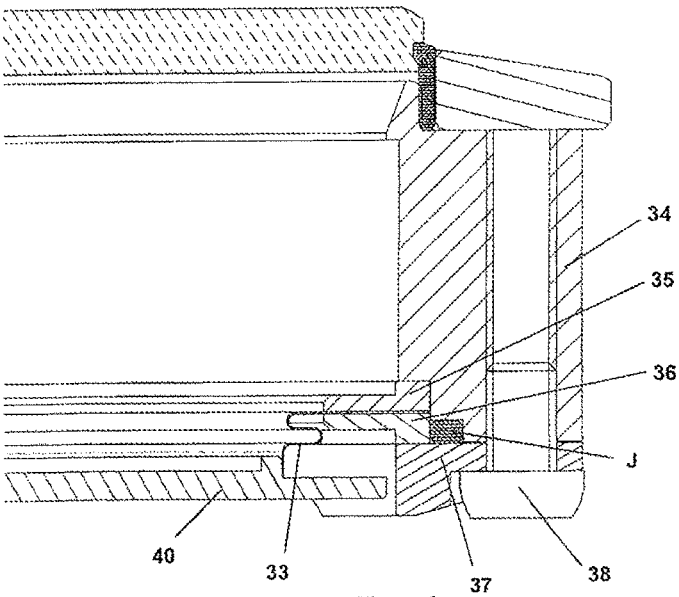
FIG. 6 is a cross-sectional view of another embodiment of the invention.

FIG. 6 relates to a variant in which an annular bellows 33 is arranged between the back 40, to which it is fixed by welding, and the middle 34. The other end of the bellows is clamped between two rings 35, 36 fastened to one another by a ring 37 fixed to the middle 34 by screws 38. A compression seal J ensures the seal-tightness of the system.

Figure 7:
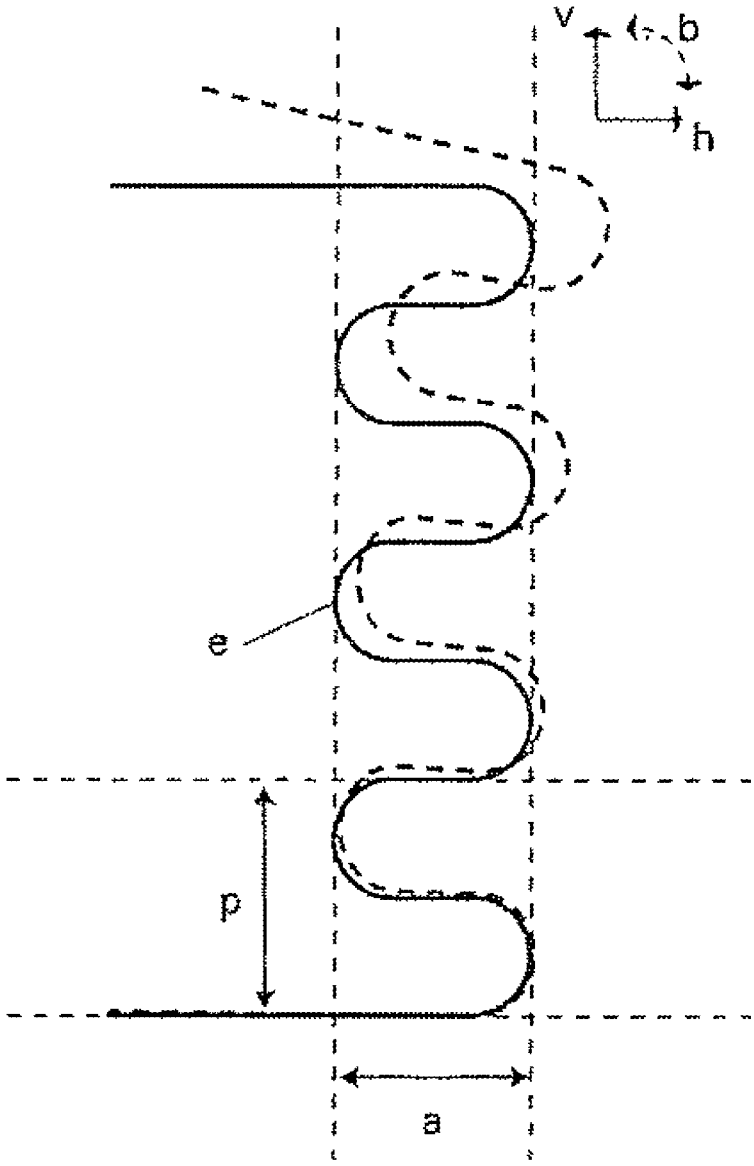
FIG. 7 is a diagram of a bellows on which are indicated the various parameters of this bellows.

We will now look at how the resilient metal member 3, 23, 33 in the form of a ring with a recessed cross section defined by the profile of a non-rectilinear wall of constant thickness, forming a bellows when it includes at least two adjacent folds forming a meander (FIG. 7), must be dimensioned. Our aim is to be able to obtain a self-guided metal member, i.e. one that is not liable to buckling or deformation, that can be integrated in a watch-making case and which has a stiffness suited to the desired function.

In the interests of simplicity, the descriptions of the stiffnesses are given firstly for a single meander, corresponding to n=1. The following parameters are therefore considered separately:

Stiffness as a function of wall thickness e

Stiffness as a function of the width a of a meander

Stiffness as a function of the dimension of the pitch p

The stiffnesses are defined by k, their index gives the vertical v, horizontal h or tilt b direction.

| Stiffness | as a function of e | as a function of a | as a function of p |
|---|---|---|---|
| Vertical and tilt | $k_v \propto k_b \propto e^3$ | $k_v \propto k_b \propto \frac{1}{a^{5/2}}$ | $k_v \propto k_b \propto \frac{1}{p^{1/5}}$ |
| Horizontal | $k_h \propto e^{3/2}$ | $k_h \propto \frac{1}{a}$ | $k_h \propto \frac{1}{p^{2/5}}$ |

Taking into account the dependencies expressed in the above table, it is possible to seek to maximize the ratio $k_h/k_v$ to facilitate and guarantee the self-guidance while having $k_v$ fixed. This ratio is a function of $e^{-1.5}$, $a^{1.5}$ and $p^{-0.2}$. Thus, for a vertical stiffness value fixed by the physical data of the system being studied, it is possible to determine a suitable thickness range. Knowing that a is necessarily greater than e, efforts must be made to minimize p within the limits of the machining techniques. Furthermore, it is essential to guarantee that the strength limits of the material are not exceeded. For greater clarity in these explanations, a numerical example and appropriate limits are given hereinafter in the description.

It is first of all interesting to discuss the influence of the number n of meanders that is expressed according to the following relationships:

| Stiffness | as a function of n |
|---|---|
| Vertical and tilt | $k_v \propto k_b \propto \frac{1}{n}$ |
| Horizontal | $k_h \propto \frac{1}{n^3}$ for large n |
| | $k_h \propto \frac{1}{n^2}$ for small n |

It is therefore essential to add a dependency at $n^{-1}$ (for small n) in the ratio $k_h/k_v$ described above. If it is to be maximized, it is therefore implicit to have the smallest n. Knowing that n can take only integer or half-integer values, n=0.5 would correspond to an ideal solution, but in the embodiments envisaged, n=1 is preferable. Furthermore, as mentioned above, it is also essential to take account of the strength limits of the materials in such a system, which is favored by increasing the value of n between 0.5 and 5, that is, between 1 and 10 alternate annular folds.

To sum up, guaranteeing the self-guidance of the system is equivalent to minimizing n and p for values of e and a linked to a stiffness defined by the physical function of the bellows.

Here, we want to illustrate and complement the above comments with two numeric examples that will be found in the following table:

| Parameter | Min limit | Example 1 | Example 2 | Max limit |
|---|---|---|---|---|
| Typical stiffness | | 50 N/mm | 500 N/mm | |
| e | 10 μm | 35 μm | 50 μm | 200 μm |
| a | 0.1 mm | 1 mm | 0.8 mm | 4 mm |
| p | >80 μm | 0.9 mm | 0.8 mm | 5 mm |
| n | 0.5 | 3 | 1 | ~5 |

These examples make it possible to define maximum and minimum limits of these various parameters according to the possible different uses of the element for closing the opening or openings of the middle of the watch case that is the subject of the invention:

The thickness e is bounded as follows:

The lower limit corresponds to the limit of the manufacturing technique. Furthermore, the mechanical stability of the bellows must be guaranteed, which is typically the case from approximately 10 μm.

The upper limit corresponds to a deposition time and to a cost that are reasonable.

The width a is bounded as follows:

The lower limit is linked to the lower limit of e. In the strictly geometrical sense, it is essential for a>10·e to guarantee a constant thickness on deposition.

The upper limit is also linked to the upper limit of e but also linked to the geometric constraints of a watch-making piece. A bellows with a>4 mm over a typical overall diameter of 30 mm cannot reasonably be envisaged.

The height p is bounded as follows:

The lower limit is linked to the mechanical constraints which demand a radius of curvature of the meander at least four times greater than e.

The upper limit is defined by the maximum allowable height for integration in a watch-making piece (with n=1).

Finally, n is bounded as follows:

The geometrical lower limit is implicit.

The upper limit must guarantee a self-guidance without buckling of the bellows, and do so for an overall diameter of the bellows of the order of 30 mm.

Figure 3:
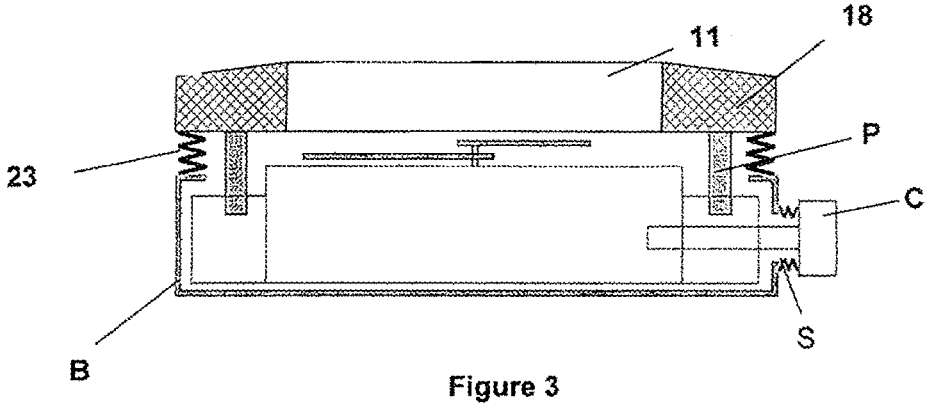
FIG. 3 is a cross-sectional view of the schematic of another embodiment.

The two examples described in the table thus give two production possibilities which allow for a watch-making integration of a metal bellows with self-guidance for two possible types of applications:

A crystal-bezel system that is mobile and tilts with a vertical displacement amplitude of the order of a millimeter for activation of functions (example 1, diagrammatically represented in FIG. 3).

A crystal-bezel system that is mobile with a vertical displacement amplitude of the order of ten or so microns for use as a loudspeaker (example 2, embodiment illustrated in FIG. 5).

The invention claimed is:

1. A watch case comprising:

a middle having at least one opening, at least one element closing said at least one opening, the closing element being selected from (i) a bezel and/or a crystal, and (ii) a back, a resilient metal member linking the closing element and the middle, said resilient metal member being in the form of a ring or a continuous frame and having a recessed cross section defined by the profile of a non-rectilinear wall whose ends are attached to the periphery of said at least one closing element and to the periphery of the middle, respectively, wherein said resilient metal member includes at least one annular fold formed by a curvature, the arc of which describes an angle in a range of more than 90° and up to 180°, wherein ends of the arc of the curvature of the fold along the profile of the non-rectilinear wall are on opposite sides of a plane parallel to the plane of the at least one opening, and the fold protrudes in a direction parallel to the plane of the at least one opening with respect to both ends of the arc of the curvature of the fold.

2. The watch case as claimed in claim 1, in which the profile of the wall of said resilient metal member includes a plurality of stacked alternate annular folds, the number of which is between 2 and 10, formed around respective planes parallel to the plane of said opening.

3. The watch case as claimed in claim 2, in which said planes parallel to the planes of said opening are planes of symmetry.

4. The watch case as claimed in claim 2, in which the thickness e of said wall is between 10 μm and 200 μm, the width a of the annular fold is between 0.2 mm and 4 mm, the pitch p of the annular fold being between >40 μm and 2.5 mm, to give said at least one closing element a freedom of movement with controlled stiffness and orientation relative to the plane of the opening.

5. The watch case as claimed in claim 4, in which said planes parallel to the planes of said opening are planes of symmetry.

6. The watch case as claimed in claim 2, in which said ends of the profile of the wall of said resilient metal member are linked in a seal-tight manner to the periphery of said closing element, respectively of the middle.

7. The watch case as claimed in claim 6, in which the ends of the wall of said resilient metal member are cylindrical, and seals are fitted between the respective cylindrical ends of the wall adjacent to cylindrical seats of said at least one closing element and of said middle, respectively and (ii) compression rings or frames in order to ensure the seal-tightness of said case.

8. The watch case as claimed in claim 2, in which said resilient metal member is at least partly made of one of the following metals or alloys: Ni+cobalt 99.8% with 0.04% sulfur, Ni with no more than 0.02% sulfur, bronze, copper, gold, silver or tin.

9. The watch case as claimed in claim 1, in which the thickness e of said wall is between 10 μm and 200 μm, the width a of the annular fold is between 0.2 mm and 4 mm, the pitch p of the annular fold being between >40 μm and 2.5 mm, to give said at least one closing element a freedom of movement with controlled stiffness and orientation relative to the plane of the opening.

10. The watch case as claimed in claim 9, in which said ends of the profile of the wall of said resilient metal member are linked in a seal-tight manner to the periphery of said closing element, respectively of the middle.

11. The watch case as claimed in claim 10, in which the ends of the wall of said resilient metal member are cylindrical, and seals are fitted between (i) the respective cylindrical ends of the wall adjacent to cylindrical seats of said at least one closing element and of said middle, respectively and (ii) compression rings or frames in order to ensure the seal-tightness of said case.

12. The watch case as claimed in claim 1, in which said ends of the profile of the wall of said resilient metal member are linked in a seal-tight manner to the periphery of said at least one closing element and of the middle, respectively.

13. The watch case as claimed in claim 12, in which the ends of the wall of said resilient metal member are cylindrical, and seals are fitted between (i) the respective cylindrical ends of the wall adjacent to cylindrical seats of said at least one closing element and of said middle, respectively and (ii) compression rings or frames in order to ensure the seal-tightness of said case.

14. The watch case as claimed in claim 1, in which said resilient metal member is at least partly made of one of the following metals or alloys: Ni+cobalt 99.8% with 0.04% sulfur, Ni with no more than 0.02% sulfur, bronze, copper, gold, silver or tin.

15. The watch case as claimed in claim 1, in which said resilient metal member is coated with poly-p-xylylene.

16. The watch case as claimed in claim 1, in which said resilient metal member is coated with zinc, gold, silver and/or titanium.

17. The watch case as claimed in claim 1, in which the thickness of the wall of said resilient metal member is constant.

18. The watch case as claimed in claim 1, in which the ends of said resilient metal member are joined by gluing, solder-brazing, electronic bombardment or by laser.

19. The watch case as claimed in claim 1, in which vertical and/or lateral abutments are arranged to limit the displacement of said at least one closing element.

20. The watch case as claimed in claim 1, in which said plane parallel to the plane of said opening is a plane of symmetry.

* * * * *